United States Patent [19]

Naka

[11] 4,103,948

[45] Aug. 1, 1978

[54] ANCHORING DEVICE

[76] Inventor: Hiromitsu Naka, No. 39, Oaza Shinmachi, Yashio-shi, Saitama-ken, Japan

[21] Appl. No.: 704,616

[22] Filed: Jul. 12, 1976

[30] Foreign Application Priority Data

Jul. 18, 1975 [JP] Japan ..... 50-87216

[51] Int. Cl.[2] ..... E05C 19/18

[52] U.S. Cl. ..... 292/256; 292/258

[58] Field of Search ..... 292/256.71, 256, 258; 24/243 CC, 243 B, 263 A, 263 LS; 52/208, 213, 214

[56] References Cited

U.S. PATENT DOCUMENTS

| | | | |
|---|---|---|---|
| 1,539,092 | 5/1925 | Krug et al. | 292/256.71 |
| 2,884,649 | 5/1959 | Scharmer | 292/256.71 |
| 3,165,341 | 1/1965 | Burns et al. | 24/243.2 X |

*Primary Examiner*—Richard E. Moore

[57] ABSTRACT

An anchoring device for use on an access door having an outer framework adapted to be fitted in a rough opening formed in a ceiling or wall and having an exposed frame flange for hiding the rough opening, the anchoring device having a pressing member having the leading end urged to engage the ceiling or wall and forming a U-shaped bracket in cooperation with the web portion and frame flange of the outer framework and an anchor urging the pressing member into engagement with the framework.

9 Claims, 30 Drawing Figures

ANCHORING DEVICE

This invention relates to an anchoring device for securing an access door to a rough opening formed in a building ceiling or wall.

Generally, a building having many stories has electric wiring, piping, air ducts and the like installed in the ceilings and walls of the building and therefore, access doors are provided in the ceilings and walls through which workers can gain access to the such wiring, piping, air ducts and the like for inspection and repair of such facilities.

The access door is usually fitted in a rough opening formed in the ceiling of each of the building stories and secured to ceiling joists, ceiling joist brackets or channeled members disposed on them which are secured to the ceiling board by means of hangers.

However, in order to cope with the recent tendency to build higher and higher buildings, the height of each story has become less and less and the ceiling space between the floor slab of one story and the ceiling of the next lower story has become smaller and smaller. As a result, it is the present practice that the wiring, piping, air ducts and the like are installed in the ceiling space nearer and nearer to the upper or unexposed surface of the ceiling panels.

Therefore, the prior art hangers have caused difficulties in securing the access door fitted in the rough opening in a ceiling to channeled members, ceiling joists, ceiling joist brackets and the use of the prior art hangers complicates the installation of the access door and increases the installation cost.

One object of the present invention is to provide an anchoring device which can precisely, positively and firmly secure an access door in a rough opening formed in a ceiling or wall, or to ceiling joists or ceiling joist brackets adjacent the opening regardless of the height of the ceiling space or the space between walls and the thickness of the ceiling or wall.

Another object of the present invention is to provide an anchoring device which makes the access door installation operation simpler and easier and accelerates such operation.

The above and other objects and attendant advantages of the present invention will be more readily apparent from the following description when read in connection with the accompanying drawings, in which FIG. 1 is a top plan view of an access door installed in a rough opening formed in a building ceiling and employing one preferred embodiment of anchoring device of the present invention;

Figure 1:
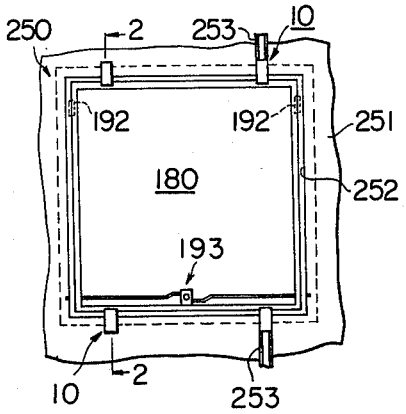
Figure 2:
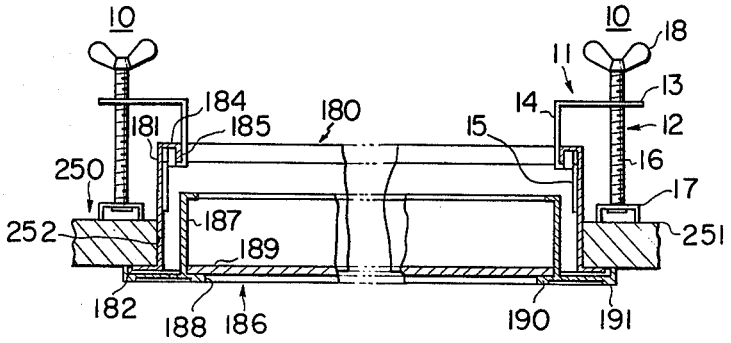
FIG. 2 is a cross-sectional view on an enlarged scale taken substantially along the line 2 — 2 of FIG. 1.

Referring to FIGS. 1 and 2, one preferred embodiment of anchoring device constructed in accordance with the present invention for anchoring an access door 180 to a rough opening in a building ceiling is generally shown by 10.

The access door 180 comprises an outer frame or framework 181 adapted to be fitted in a rough opening 252 in a ceiling panel 251 and a cover 186 hinged to the outer framework 181 at 192 for closing and uncovering the opening 183 defined in the outer framework 181.

Particularly, the outer framework 181 has an outwardly extending peripheral flange 182 integrally formed with the lower end which serves as an exposed frame flange for closing the rough opening 252 in the ceiling board 251 and the outer framework 181 also has an inwardly extending annular flange 184 integrally formed with the upper end and having an integral rib 185 depending from the free end of the annular flange.

And the cover 186 comprises a cover framework 187 defining an opening 188 therein and a cover plate 189 for closing the opening 188 and the cover framework 187 has an inwardly extending annular flange 190 and an outwardly extending peripheral flange 191 integrally formed with the lower end. Furthermore, when the cover 186 closes the opening 183 in the outer framework 181, the cover 186 is locked to the outer framework 181 by means of cremorne lock means 193.

The access door 180 having the above-mentioned construction is anchored to the ceiling panel 251 around the ceiling rough opening 252 by means of four separate anchoring devices 10 arranged in pairs.

One pair of anchoring devices 10 anchor one side of the access door 180 directly to the ceiling panel 251 and the other pair of anchoring devices 10 anchor the opposed side of the access door 180 to the ceiling panel with ceiling joists 253 interposed therebetween.

Each of the anchoring devices 10 comprises a hanger member 11 as anchoring means and a screw-threaded clamping member 12 serving as pressing means or a movable screw. The hanger member 11 has a substantially L-shaped construction including a support arm portion 13 and a hook portion 14 integrally formed with the support arm portion and having a stop portion 15 at the lower end.

The movable screw 12 is in the form of a thumb screw and more particularly, the thumb screw 12 includes a threaded shank 16 having a channeled washer 17 riveted to the lower end and a thumb nut 18 integrally formed with the upper end. The threaded shank 16 is in threaded engagement in a threaded hole (not shown) in the support arm porton 13.

A description will be now given of an instance in which the access door 180 is anchored to the rough opening 252 in the ceiling panel 251 by the use of the anchoring devices 10. First of all, with the cover 186 in its open position, the outer framework 181 is fitted in the ceiling rough opening 252 until the exposed frame flange or outwardly extending peripheral flange 182 at the lower end of the outer framework 181 engages the lower surface of the ceiling panel 251. The hook portions 14 of the hanger members 11 then engage the rib 185 integrally formed with the upper end of the inwardly extending annular flange 184 of the outer framework 181. In this way, the hanger members 11 cooperate with the web portion of the outer framework 181 and exposed frame flange 182 to provide a U-shaped bracket.

The thumb screws 12 are then turned in the tightening direction until the channeled washers 17 come into contact with the upper surface of the ceiling panel 251 with a light force and following the rotation of the thumb screws 12 in the manner mentioned just hereinabove, the position of the outer framework 181 with respect to the ceiling rough opening 252 is properly adjusted. Thereafter, the thumb screws 12 are further rotated in the tightening direction until the outer framework 181 is firmly anchored to the ceiling board 251 around the ceiling rough opening 252 to thereby complete the anchoring of the access door 180 to the ceiling rough opening.

In connection with FIGS. 1 and 2, although a description has been given of the instance in which the washers 17 of the thumb screws 12 directly abut against the upper surface of the ceiling panel 251, it is also possible that the access door 180 is anchored to the ceiling panel 251 by providing ceiling joists or auxiliary channeled members between the washers 17 of the anchoring devices 10 and the upper surface of the ceiling panel 251.

Figure 3:
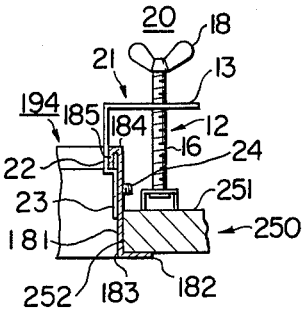
FIGS. 3 through 6 and 8 are fragmentary side elevational views, partly in section, of modified embodiments of the present invention which correspond to the right-hand portion of FIG. 2.
Figure 4:
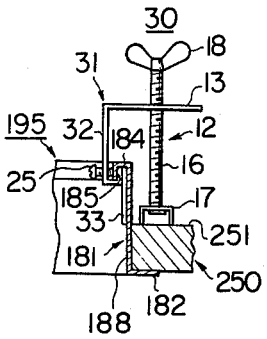
Figure 5:
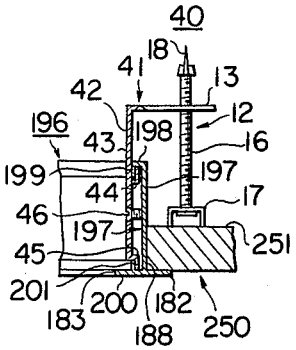

FIGS. 3 through 5 show modified embodiments 20, 30 and 40 of the present invention. Each of the modified embodiments 20, 30 and 40 includes a modification of the hanger member 11 employed in the foregoing embodiment of hanger member 10 and the parts of these modified embodiments 20, 30 and 40 which correspond to those of the first embodiment 10 are assigned the corresponding numerals thereto, respectively.

In FIGS. 3 through 5, the access doors 194, 195 and 196 adapted to be fitted in the rough opening 252 in the ceiling panel 251 and secured to the ceiling board include outer frames or frameworks 181, 181 and 197, respectively, but have the cover as shown in FIGS. 1 and 2 omitted therefrom.

The anchoring device 20 of FIG. 3 includes a hanger member 21 bent to integrally form a hook portion 22 and a stop portion 23 and the stop portion 23 is adapted to be secured to the outer framework 181 by means of a screw 24 when the hook portion 23 engages the rib 185 on the outer framework 181. Thus, the outer framework 181 is positively secured to the hanger member 21.

The operation for securing the access door 194 to the rough opening 252 in the ceiling panel 251 by the use of anchoring devices 20 is substantially the same as the securing operation by the use of anchoring devices 10 as shown in FIGS. 1 and 2 except that the step of securing the stop portions 23 to the outer framework 181 by screws 24 is added.

In the anchoring device 30 of FIG. 4, the hanger member 31 includes separate hook and stop portions 32 and, 33 and the upper end portion of the stop portion 33 extends above the lower end portion of the hook portion 32 and is secured to the rib 185 by means of a clamping screw 25 extending through the hook portion 32.

Thus, the outer framework 181 is positively secured to the hanger member 31. The operation for securing the access door 195 to the rough opening 252 in the ceiling panel 251 by means of anchoring devices 30 is substantially the same as that followed in the case of anchoring devices 20 of FIG. 3.

The anchoring device 40 of FIG. 5 is modified to be suitably employed in connection with an outer framework 197 including an inwardly extending annular flange 198 at the upper end and a rib 199 depending from the free end of the flange and an inwardly extending annular flange 201 at the lower end, respectively.

In the anchoring device 40, the main body 43 of the hook portion 42 extends to the lower end of the outer framework 197 and is provided midway of the length thereof with an engaging projection 44 and at the lower end with an engaging pawl 45, respectively. The main body 43 of the hook portion 42 is secured to the outer framework 197 by means of a screw between the engaging projection 44 and engaging pawl 45. The screw 46 may be replaced by a movable screw which acts to vary the distance between the hook portion main body 43 and outer framework 197. Furthermore, the operation for securing the access door 196 to the rough opening 252 in the ceiling panel 251 by the use of anchoring devices 40 is substantially the same that in the case of the use of anchoring devices 20 in FIG. 3.

Figure 6:
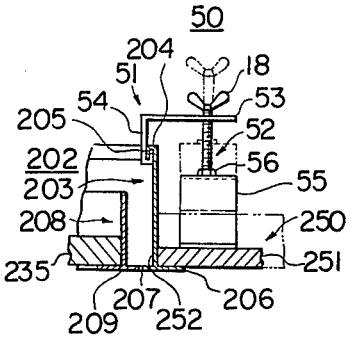
Figure 7:
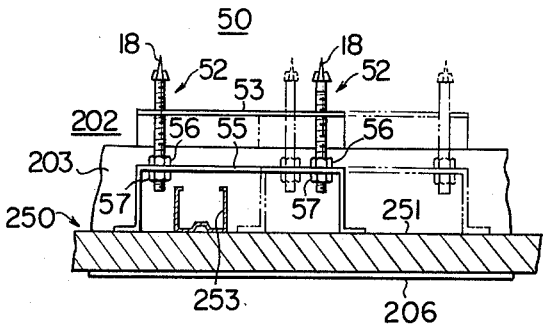
FIG. 7 is an elevational view, partly in section, as seen from the right-hand side of FIG. 6.

FIGS. 6 and 7 show a modified and preferred embodiment 50 of the present invention and this anchoring device 50 comprises a hanger member 51 and two spaced clamping screws 52 and the hanger member 51 is bent in a substantially L-shape to form a support arm portion 53 and a hook portion 54.

The hook portion 54 is adapted to engage an inwardly extending annular flange 204 at the upper end of the outer framework 203 and a rib 205 depending from the free end of the flange 204 and the hanger member 51 is not provided with the stop portion 15 as provided in the hanger member 11.

The clamping screws 52 are threaded in spaced positions along the hanger member 51 for vertical movement and have a common leg 55 secured to the lower ends by means of nuts 56 and 57. The leg 55, of course, corresponds to the washer 17 of the thumb nut 12 shown in FIG. 2. As can be appreciated from FIG. 6, in the access door 202 fitted in the rough opening 252 in the ceiling panel 251 and secured to the ceiling panel, the outwardly extending peripheral flange 206 at the lower end of the outer flange or framework 203 is not covered by the outwardly extending peripheral flange 209 of the cover 207. Furthermore, the access door 202 is secured to the ceiling board 251 by causing the hook portion 54 of each hanger member 51 to engage the inwardly extending annular flange 204 and rib 205 at the upper end of the outer framework 203 and manipulating the nuts 56 and 57 and clamping screws 52.

If the outer framework 203 is also provided at the upper end with an outwardly extending annular flange having a rib similar to the inwardly extending annular flange 204, it is sufficient simply to bend the hook portion 54 in the opposite direction from that of FIG. 6 so as to form the engaging projection 44 at the lower end of the main body 43 on the side opposite from that of FIG. 6.

Figure 8:
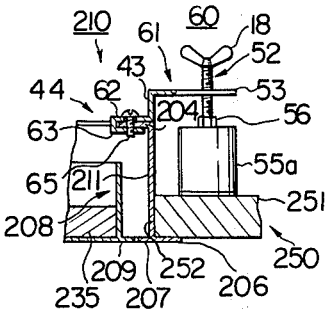
Figure 9:
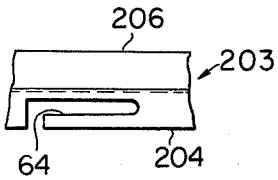
FIG. 9 is a fragmentary top plan view on an enlarged scale of the outer framework of said access door as seen from above in FIG. 8.

FIGS. 8 and 9 show a modified and preferred embodiment 60 of the present invention and this anchoring device 60 includes a hanger member 61 which is a modification of the hanger member 51 of FIG. 6 and a modified leg 55*a* in which one clamping screw 52 is threaded. The parts of the anchoring device 60 which correspond to those of the anchoring device 50 are assigned the corresponding numerals thereto. That is, the anchoring device 60 is adapted to be employed in conjunction with an access door 210 the outer framework 203 of which is provided at the upper end with an inwardly extending annular flange 204 which is not provided with the part corresponding to the rib 204 provided in the embodiment 50.

In the hanger member 61 of the anchoring device 60, the main body 43 of the support arm portion 53 has an engaging projection 44 integrally formed with the lower end and the engaging projection 44 is bent so as to form a pair of jaws 62 and 63 which pinch the inwardly extending annular flange 204 at the upper end of the outer framework 211 therebetween. The jaws 62 and 63 and annular flange 204 are secured together by means of a screw 65. The upper inwardly extending annular flange 204 is formed with a L-shaped slot 64 (see FIG. 9) for receiving the screw 65 so that the position of the anchoring device 60 with respect to the access door 210 can be adjusted. In the installation of the access door 210 on the ceiling 251, the outer framework 211 is first fitted in the rough opening 252, the jaws 62 and 63 of the hanger mamber 61 are fitted on the upper inwardly extending annular flange 204 and the position of the anchoring device 60 with respect to the access door 210 is adjusted. After the adjustment, the clamping screw 52 and nuts 56 and 57 are manipulated to secure the outer framework 211 to the ceiling panel 251 and the screw 65 is tightened to firmly secure the jaws 62 and 63 to the upper inwardly extending annular flange 204.

Figure 10:
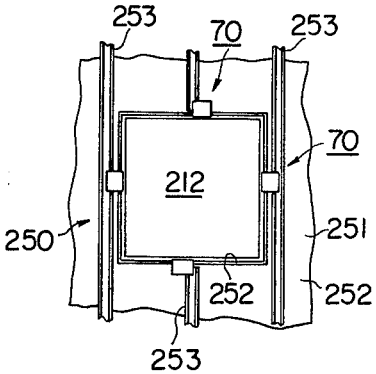
FIG. 10 is a top plan view of an access door installed in a rough opening formed in a building ceiling and anchored to ceiling joists by employing a modified embodiment of the present invention.
Figure 11:
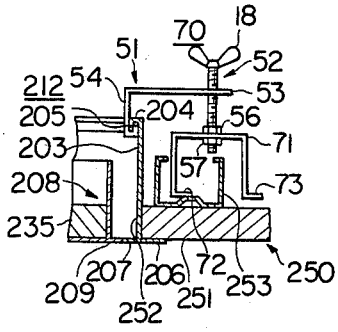
FIG. 11 is a side elevational view, partly in section, of a modified embodiment of the present invention with the leg positioned on an upright ceiling joist on one side of the outer framework of said access door as seen in FIG. 10.
Figure 12:
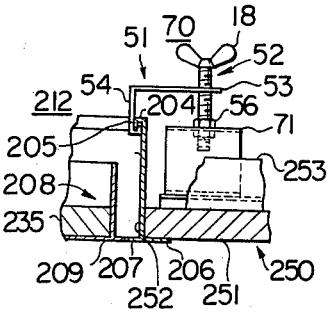
FIG. 12 is a side elevational view of the embodiment of FIG. 11 with the leg positioned on a ceiling joist arranged parallel to the side face of said outer framework of the access door of FIG. 10.

FIGS. 10 through 12 show a further modified and preferred embodiment 70 of the present invention and the anchoring device 70 is adapted to secure the access door 212 to the ceiling board 252 with the intermediary of a ceiling joist 253 provided adjacent to the rough opening 252. The anchoring device 70 includes a modification of the leg 55 of the anchoring device 50 shown in FIGS. 6 and 7.

The anchoring device 70 includes one clamping screw 52 having one leg 71 at the lower end. More particularly, the leg 71 is pinched between a pair of nuts 56, 57 threaded on the lower end of the clamping screw 52 to be held in position. As shown in FIG. 11, the leg 71 has a groove-shaped cross-section and is bent laterally at the opposite ends to form a pair of feet 72, 73 extending in the same horizontal plane.

The remaining parts of the anchoring device 70 are similar to the corresponding parts of the anchoring device 50 and accordingly, corresponding numerals are assigned to the corresponding parts. And the access door 212 shown in FIGS. 10 through 12 is similar to that shown in FIG. 6 and the corresponding parts of the access door are assigned corresponding numerals.

Figure 13:
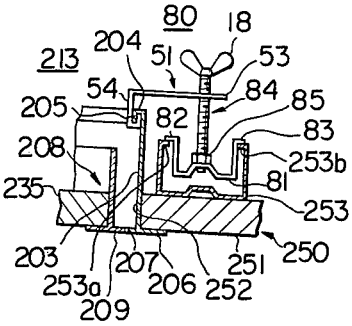
FIG. 13 is a view similar to FIG. 11, but shows a modified embodiment of the present invention having a modified leg.
Figure 14:
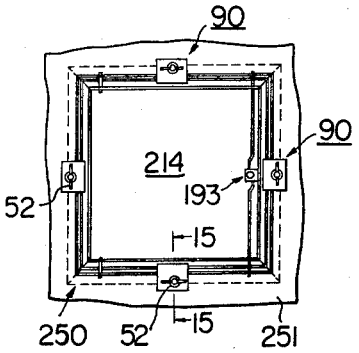
FIG. 14 is a top plan view of an access door installed in a rough opening of a building ceiling board and anchored to the ceiling board associated with the ceiling by employing a modified embodiment of the present invention.
Figure 15:
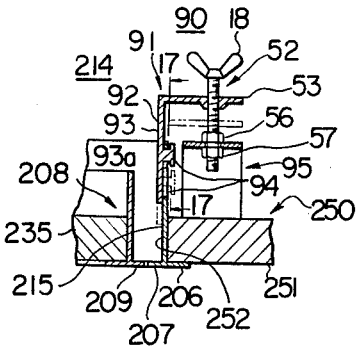
FIG. 15 is a cross-sectional view taken substantially along the line 15 — 15 of FIG. 14.
Figure 16:
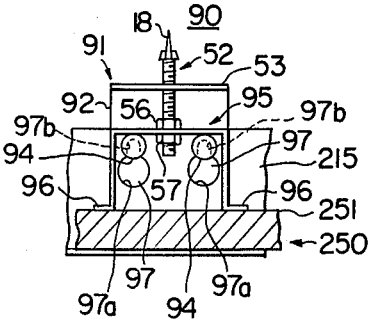
FIG. 16 is a view as seen from the right-hand side of said embodiment as shown in FIG. 15.
Figure 17:
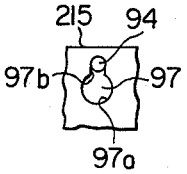
FIG. 17 is a partial elevation view taken substantially along the line 17 — 17 of FIG. 15.

FIG. 13 shows a further modified and preferred embodiment 80 of the present invention and the anchoring device 80 includes a modification of the leg 71 of the anchoring device 70 shown in FIG. 11. The remaining parts of the anchoring device 80 are similar to the corresponding parts of the anchoring device 70 and accordingly, are assigned the corresponding numerals. And the access door 213 of FIG. 13 is similar to the access door 212 and accordingly, the corresponding parts of the anchoring device 80 are assigned corresponding numerals thereto.

The leg 81 of the anchoring device 80 has a groove-shaped cross-section and is bent outwardly and horizontally at the opposite ends to form a pair of feet 82 and 83. Nuts 85 are threaded to the lower end of a clamping screw 84 to hold the anchoring device 80 in position with the feet 82 and 83 positioned above the nut 85.

Thus, a ceiling joist 253 having the ceiling panel 251 secured thereto is generally formed of a grooved steel having inturned flanges 253*a* and 253*b* and since the ceiling joist 253 is supported within the rough opening by means of a hanger member (not shown) with the groove of the joist opening upwardly, when the leg 81 secured to the clamping screw 84 is fitted in the groove of the ceiling joist 253, the feet 82 and 83 of the leg 81 engage the ribs 253*a* and 253*b* to thereby secure the access door 213 to the ceiling joist 253.

The anchoring device 80 can also be directly secured to the ceiling panel 251 without the employment of the ceiling joist 253.

FIGS. 14 through 19 show a further modified and preferred embodiment of the present invention. The anchoring device 90 utilizes a modification of the relationship between the clamping screw 52 and leg 55 shown in FIG. 6 and a modification of the hanger member 51 shown in FIG. 6, respectively.

The clamping screw 52 of the anchoring device 90 has a leg 95 secured at the lower end by means of nuts 56 and 57. However, the anchoring device 90 does not use two clamping screws 52 in the anchoring device 50 as shown in FIG. 6, but only one clamping screw 52 and the leg 95 in the anchoring device 90 is in the form of a channeled member and bent at the opposite ends to form a pair of outwardly and horizontally extending feet, 96.

The hanger member 91 of the anchoring device 90 has a support arm portion 53 one end of which is bent downwardly to form a hook portion 92 and the downwardly extending main body 93 of the hook portion 92 has two spaced hook projections 94 midway of the main body and integrally formed therewith. The extreme lower end portion 93*a* of the main body 93 below the projections 94 serves as a stop like the stop 15 described hereinabove.

The access door 214 fitted in the rough opening 252 and secured to the ceiling panel 251 is also modified in conformity with the modified construction of the hanger member 91.

More particularly, the outer frame or framework 215 of the access door 214 does not have the upper end inwardly extending annular flange 204 and the rib 205 provided on the outer framework 202 shown in FIG. 6 and instead is provided with engaging holes 97 in positions suitable for receiving the hook projections 94. Each engaging hole 97 comprises a combination of a larger diameter hole portion 97*a* and a smaller diameter hole portion 97*b*.

Thus, when the access door 214 is secured to the rough opening 252 in the ceiling panel 251 by the employment of the anchoring devices 90, first of all, the outer framework 215 is fitted in the rough opening 252 until the lower end outwardly extending peripheral flange 206 engages the ceiling panel 251. In each of the anchoring devices 90, since the clamping screw 52 has been previously moved to an upper portion along the support arm portion 53, the hook projection 94 is first received in the larger diameter hole portion 97*a* and the hanger member 91 is then moved upwardly together with the clamping screw 52 and leg 95 to move the hook projection 94 into the smaller diameter hole portion 97*b* whereby the outer framework 215 is suspended from the ceiling panel 251. Thereafter, the clamping screw 52 is screwed in until the leg 95 abuts against the upper surface of the ceiling panel 251 whereupon the access door 214 is secured to the ceiling board 251.

Figure 18:
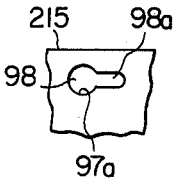
FIGS. 18 and 19 are similar to FIG. 17, but show modified engaging holes.
Figure 19:
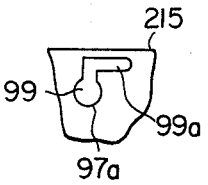

FIGS. 18 and 19 show more preferable forms of the engaging hole and the engaging holes 98 and 99 in these Figures have elongted hole portions 98*a* and 99*a*, respectively, which replace the smaller diameter hole portion 97*b* so that the position of the anchoring device 90 with respect to the outer framework 215 can be adjusted.

Figure 20:
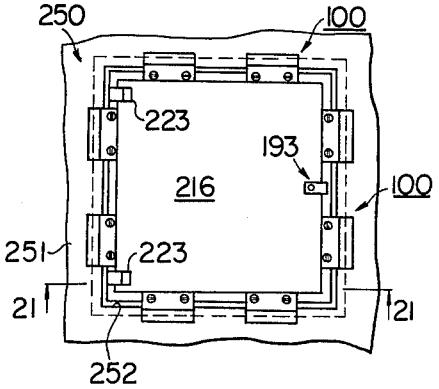
FIG. 20 is a top plan view of an access door installed in a ceiling rough opening by employing a modified embodiment of the present invention.
Figure 21:
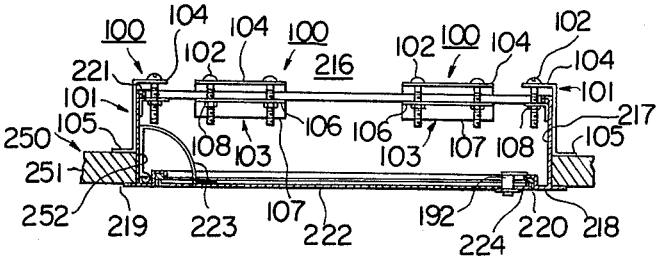
FIG. 21 is a cross-sectional view taken substantially along the line 21 — 21 of FIG. 20.

FIGS. 20 and 21 show an access door 216 secured in the rough opening 252 in the ceiling board 251 by the employment of a further modified embodiment of the present invention.

The access door includes a regular square outer framework 217 having an opening 220 to be fitted in the rough opening 252 in the ceiling panel 251 and a cover 222 hinged to the outer framework 217 at 223 for closing and uncovering the opening 220 in the outer framework 217. When the cover 222 is closed, the cover is locked to the outer framework 217 by means of cremorne lock means 192.

The outer frame or framework 217 comprises four identical outer framework elements and corner members interposed between the adjacent or opposed ends of each two framework elements which are secured together by means of screws to thereby form a framework. The outer framework 217 includes an inwardly extending annular flange 218 and an outwardly extending peripheral flange 219 at the lower end and an inwardly extending annular flange 221 and at the upper end, respectively. The lower end inwardly extending annular flange 218 includes a seal member 224 to provide a seal between the outer framework 217 and cover 222.

When the outer framework 217 is fitted in the rough opening 252 in the ceiling board 251, the lower end outwardly extending peripheral flange 219 engages the ceiling board 251 around the rough opening 252.

The anchoring device 100 includes a pressing member 101 serving as pressing means, two clamping screws 102 serving as anchoring means and a bracket 103. The pressing member 101 is formed of a Z-shaped cross-section steel member and includes an upper bent portion 104 at the upper end and a lower bent portion 105 at the lower end, respectively. The upper bent portion 104 has two holes therethrough (not shown) and the lower end bent portion 105 engages the ceiling panel 251.

The bracket 103 is formed of an angled cross-section steel member and includes a horizontal support portion 106 corresponding to the web portion and an anchoring portion 107 corresponding to the flange portion of the angle steel, respectively. The anchoring portion 107 is welded to the inner surface of the outer framework 217.

The bracket 103 has two holes therethrough (not shown) in the horizontal support portion 106 for receiving the clamping screws 102. These holes are preferably in the form of an elongated slot so that the lateral position of the outer framework 217 can be adjusted. If the elongated slot is formed as an open elongated slot having a notch in a portion along the periphery of the slot, the clamping screws 102 can be easily guided into the slots.

In the anchoring device 100, nuts 108 are threaded on the respectively associated clamping screws 102 to fasten the upper bent portions 104 and horizontal support portions 106 together so as to pinch the ceiling panel 251 between the lower end outwardly extending peripheral flange 219 and the lower end bent portion 105. It is also contemplated that the nuts 108 are previously positioned on the associated horizontal support portion 106 in alignment with the associated holes and then welded to the horizontal support portion 106. And if the holes are threaded holes, the nuts 108 can be omitted. The brackets 103 can be, of course, previously welded to the outer side of the outer framework 217 and in such a case, the brackets 103 are positioned flush with the outer surface of the outer framework 217.

The operation for securing the access door 216 to the ceiling board 251 will be fully understood when a description is given of the anchoring of the outer framework 217 of the access door 216 to the rough opening 252. In the installation of the access door to the outer framework 217, first of all, the outer framework 217 is fitted in the rough opening 252 in the ceiling panel 251, the pressing members 101 are positioned on the sides of the outer framework 217 (see FIG. 20) and the clamping screws 102 are inserted from the upper bent portions 104 through the horizontal support portions 106. Thereafter, the nuts 108 are threaded and fastened on the clamping screws 102 whereby the outer framework 217 is secured to the ceiling panel 251 around the rough opening 252.

Figure 22:
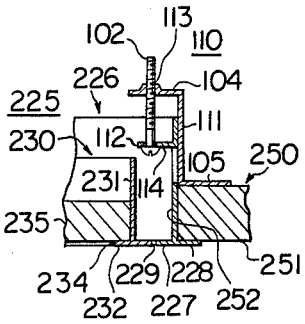
FIG. 22 is a cross-sectional view of a modified embodiment of the present invention showing the same being employed to secure an access door to a ceiling rough opening.

FIG. 22 fragmentarily shows an access door 225 secured to the rough opening 252 in the ceiling panel 251 by the employment of a further modified embodiment of the present invention.

This access door 225 includes an outer frame or framework 226 and a cover 230 and the outer framework has an inwardly extending annular flange 227 and an outwardly extending peripheral flange 228 at the lower end. The outer framework 226 normally has no inwardly extending annular flange at the upper end. The cover 230 for uncovering and closing the opening 229 in the outer framework 226 comprises a cover frame or framework 231 having an inwardly extending annular flange 232 and an outwardly extending peripheral flange 233 similar to the corresponding flanges of the outer framework 226 at the lower end and a cover plate 235 for uncovering and closing the opening 234 in the cover framework. The cover 230 is hinged to the outer framework 226. When closed, the cover 230 is also locked to the outer framework 226 by cremorne lock means.

The anchoring device 110 for securing the access door 225 to the rough opening 252 in the ceiling board 251 is substantially similar to the embodiment 100 of FIG. 21 except that the nuts 108 are omitted and the bracket 103 is replaced by a bracket 112 which is formed by cutting and bending a portion of the outer framework 226. The parts of the embodiment 110 which correspond to those of the embodiment 100 are assigned corresponding numerals thereto.

The pressing member 111 of the anchoring device 110 has a bent upper portion 104 provided with a threaded hole 113 for receiving a clamping screw 102 which also extends through a threaded hole 114 in the bracket 112. The operation for securing the access door 225 to the rough opening 252 in the ceiling board 251 is similar to that for the embodiment 100.

In the anchoring device 110, if the outer framework 226 has the upper end inwardly extending annular flange 204 as provided in the outer framework in FIG. 8, the annular flange 204 concurrently serves as the bracket 112. And if the outer framework 226 is constructed as shown in FIG. 5, the bracket 112 may be formed by cutting and bending a portion of a plate so as to engage the rib 199 of the upper end inwardly extending annular flange 198 and the rib 201 of the lower end inwardly extending annular flange 200 (FIG. 5).

Figure 23:
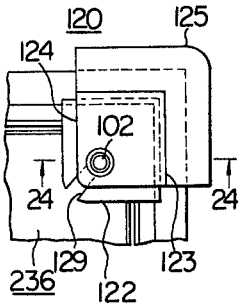
FIG. 23 is a top plan view of a modified embodiment of the present invention showing the same being employed to secure an access door to a ceiling rough opening.
Figure 24:
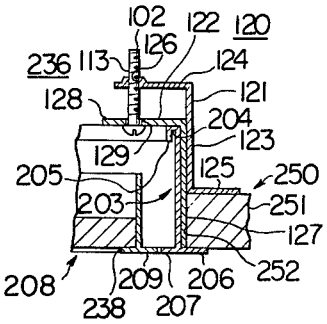
FIG. 24 is a crosss-sectional view taken substantially along the line 24 — 24 of FIG. 23.

FIGS. 23 and 24 fragmentarily show an access door 236 secured to the rough opening 252 in the ceiling board 251 by the use of a further modified embodiment 120 of the present invention and since the access door 236 is similar to the access door 202 shown in FIG. 6 and 7, the parts of the access door 236 which correspond to those of the access door 202 are assigned corresponding numerals.

The anchoring device 120 is positioned at each of the four corners of the access door 236 and includes a pressing member 121 positioned on the associated side of the outer framework 203, a bracket 122 disposed between the outer framework side and pressing member 121 and welded to the outer framework side and a clamping screw 102 positioned between the pressing member 121 and bracket 122 to firmly pinch the ceiling panel 251 between the lower end outwardly extending peripheral flange 206 and pressing member 121.

The pressing member 121 has a L-shaped cross-section and includes a web portion 123, a top plate portion 124 at the upper end of the web portion 123 and a foot plate portion 125 at the lower end of the web portion 123. The top plate portion 125 has a threaded hole 126 for receiving a clamping screw 102. The bracket 122 includes an anchoring portion 127 welded to the outer surface of the associated side of the outer framework 303 for securing the bracket 122 to the outer framework and a horizontal engaging portion 128 at the upper end of the anchoring portion 127. The horizontal engaging portion 128 has an elongated hole 129 therein for receiving the clamping screw 102.

Thus, the operation for securing the access door 236 to the rough opening 252 in the ceiling board 251 will be fully understood from a description of the installation of the outer framework 203 of the access door 236 to the rough opening 252 in the ceiling panel 251.

In the installation of the outer framework 203, since the bracket 122 has been previously welded to the outer framework 203, the outer framework 203 is fitted in the rough opening 252 in the ceiling panel 251 and the outer framework 203 is pushed upwardly until the lower end outwardly extending peripheral flange 206 engages the lower surface of the ceiling panel 251. The pressing member 121 is positioned on the outer surface of the bracket 122, the clamping screw 102 is inserted in the notched hole 129 in the horizontal portion 128 while the threaded portion of the clamping screw 102 is threaded into the threaded hole 126 in the top plate portion 124 to fasten the top plate portion 124 and horizontal engaging portion 128 together so as to firmly pinch the ceiling panel 251 between the pressing member 121 and foot plate portion 125 whereby the outer framework 203 is secured to the ceiling panel 251.

The cover 208 of the access door 236 comprises a cover framework 237 having an inwardly extending annular flange 238 and an outwardly extending peripheral flange 209 at the lower end and a cover plate 239 secured to the inwardly extending annular flange 238. The cover 208 is hinged to the outer framework 202 and as mentioned hereinabove in connection with the preceding embodiments, when closed, the cover 208 is locked to the outer framework 202 by means of cremorne lock means (not shown).

Figure 25:
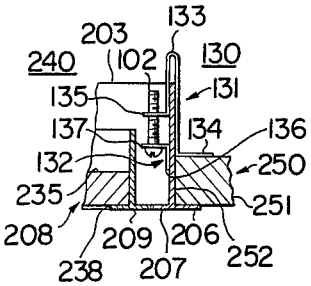
FIGS. 25 and 26 are sectional elevational views of modified embodiments of the present invention.

FIG. 25 fragmentarily shows an access door 240 secured to the rough opening 252 in the ceiling panel 251 by the employment of a further modified embodiment of the present invention. The access door 240 is substantially similar to the access door 236 shown in FIGS. 23 and 24 except that the inwardly extending annular flange 204 and rib 205 at the upper end of the outer framework 203 in the access door 236 shown in FIGS. 23 and 24 are omitted and the parts of the access door 240 which correspond to those of the access door 236 are assigned corresponding numerals.

The anchoring device 130 comprises a pressing member 131, a bracket 132 and a clamping screw 102. The pressing member 121 has a folded portion 133 positioned above the outer framework 203, an outwardly extending flange 134 at the lower end positioned outside of the outer framework 203 and an inwardly extending upper flange 135 positioned within the outer framework 203 in a midway between the upper and lower ends thereof. The upper flange 135 has a threaded hole (not shown) for receiving the clamping screw 102.

The bracket 132 is bent in a substantially L-shape to form an upright anchoring portion 136 and a horizontal engaging portion 137. The anchoring portion 136 is welded to the inner surface of the outer framework 203. The bracket 132 is, of course, welded to the inner surface of the outer framework 203 in a lower portion of the framework spaced from and below the upper flange 135. Furthermore, the horizontal engaging portion 137 has a threaded hole (not shown) for receiving the clamping screw 102.

Since the anchoring device 130 has the above-mentioned construction and the bracket 132 has been previously welded to the inner surface of the outer framework 203 in a predetermined position, the outer framework 203 is secured to the rough opening 252 in the ceiling board 251 in the same manner as in the case of the embodiment of FIGS. 23 and 24.

Particularly, since the pressing member 131 of the anchoring device 130 has the folded portion 133, the upper flange 135 is reinforced by the folded portion 133.

Figure 26:
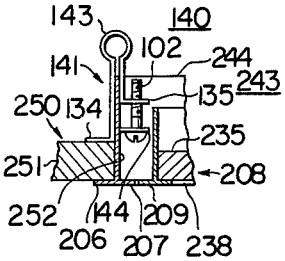

FIG. 26 fragmentarily shows an access door 243 secured to the rough opening 252 in the ceiling panel 251 by the use of a further modified embodiment of the present invention. The anchoring device 140 employed for securing the access door 243 includes modifications of the pressing member 131 and bracket 132 employed in the anchoring device 130 of FIG. 25. The pressing member 141 of the anchoring device 140 includes a looped portion 143 corresponding to the folded portion 133 of the pressing member 131 and a portion of the outer framework 244 is cut and bent inwardly to form a bracket 144 corresponding to the horizontal engaging portion 137 of the bracket 132 (FIG. 25).

The operation for securing the access door 244 to the rough opening 252 in the ceiling panel 251 by the use of the anchoring device 140 is similar to that of the embodiment of FIGS. 23 and 24.

Figure 27:
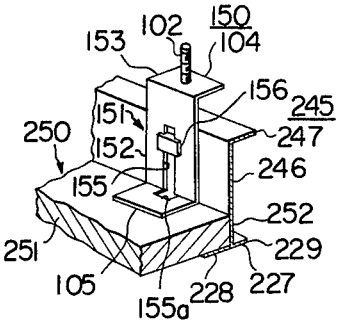
FIG. 27 is a perspective rear view of a modified embodiment of the present invention showing the same being employed to secure an access door to a ceiling rough opening.

FIG. 27 fragmentarily shows an access door 245 secured to the rough opening 252 in the ceiling panel 251 by the use of a further modified embodiment of the present invention. The anchoring device 150 is substantially similar to the anchoring device 110 of FIG. 22 except that the bracket 112 of the pressing member 111 in FIG. 22 is replaced by an inwardly extending annular flange 247 integrally formed with the upper end of the outer frame or framework 246.

Furthermore, in the anchoring device 150, the web portion 152 of the pressing member 151 is provided with a vertically extending slot 155 in which an engaging projection 156 extending from the outer surface of the outer framework 246 engages. The slot 155 is provided at the lower end with an enlarged portion **155*a* through which the engaging projection 156 is inserted into the slot 155. Thus, when the upper bent portion 153 of the pressing member 151 and the upper end inwardly extending flange 247 are fastened together by the clamping screw 102, the lower portion of the web portion 152 of the pressing member 151 is prevented from moving away from the outer surface of the outer framework 246**.

The parts of the anchoring device 150 and access door 245 which correspond to those of the anchoring device 150 and access door 225 are assigned corresponding numerals, respectively.

Figure 28:
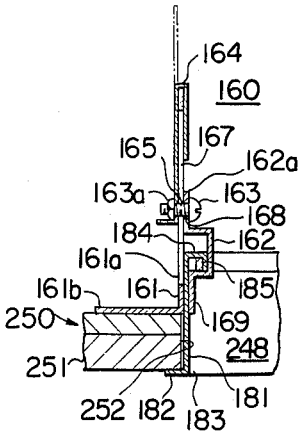
FIGS. 28 and 29 are cross-sectional views of modified embodiments of the present invention showing the same being employed to secure an access door to a ceiling rough opening.

FIG. 28 fragmentarily shows an access door 248 secured to the rough opening 252 in the ceiling panel 251 by the use of a further modified embodiment of the present invention. The access door 248 is substantially similar to the access door 180 shown in FIG. 3 except that the cover hinged to the outer framework 181 shown in FIG. 3 for uncovering and closing the opening 183 in the outer framework is eliminated. As is clear from FIG. 28, the outer framework 181 has an outwardly extending peripheral flange 182 at the lower end and an inwardly extending annular flange 184 having an integral bent rib 185 at the upper end.

The anchoring device 160 for securing the access door 248 to the rough opening 252 in the ceiling board 251 comprises a support column 161 disposed on the upper surface of the ceiling board 251, a hook member 162 engaging the upper end inwardly extending annular flange 184 and rib 185 of the outer framework 181, a bolt and nut assembly 163, **163*a* and a bendable strip piece 164 for securing the outer framework 181 to the support column 161 through the hook member 162**.

The support column 161 comprises a support column portion **161*a* and a foot portion 161*b* integral with and bent from the lower end of the support column portion 161*a* and the support column portion 161*a* is provided with a vertical elongated slot 167. The hook member 162 has a hole 168 at the upper end of the hook portion 162*a* for receiving the bolt 163**.

A stop portion 169 extends downwardly from the lower end of the hook portion **162*a*. The lower end of the strip piece 164 also has a hole 165 for receiving the bolt 163**.

The access door 248 is installed in the rough opening 252 in the ceiling panel 251 by inserting the outer framework 181 into the rough opening 252 in the ceiling panel 251 and securing the outer framework 181 to the ceiling panel 251 by the use of the anchoring devices 160. More particularly, the outer framework 181 is first fitted in the rough opening 252 in the ceiling panel 251 and the outer framework is pushed upwardly until the lower end inwardly extending annular flange 182 makes contact with the lower surface of the ceiling panel 251. The hook member 162 is caused to engage the upper end inwardly extending flange 184 and rib 185, the support column 161 is disposed on the upper surface of the ceiling board 251 outside of the outer framework 181 and the bolt 163 is passed the through hole 165 in the hook member 162 and the elongated slot 167 in the support column 161.

Thereafter, a nut **163*a* is threaded on the threaded portion of the bolt 163 extending from the hook member 162 through the strip piece 164 and loosely fastened. Thereafter, the ceiling panel 251 is firmly pinched between the lower end outwardly extending peripheral flange 182 and the foot portion 161*b* of the support column 161 and the nut 163*a* is further tightened to secure the hook member 162 to the support column 161. Thereafter, the upper end of the strip piece 164 is bent over the upper end of the support column 161 to cause the strip to engage the ceiling panel 251 and the lower end of the strip piece 164 is bent to prevent the nut 163*a* from loosening to thereby secure the outer framework 181 in the rough opening 252**.

The anchoring device 160 described just above may be varied in many ways and for example, the hook member 162 may be formed in the shape of a straight plate by eliminating the hook portion and the lower end of the hook member may be secured to the outer framework 181 by means of a screw. And if the height of the outer framework 181 is sufficiently great for the thickness of the ceiling panel 251, the hook member 162 may be eliminated and instead the outer framework 181 may be provided with a hole corresponding to the hole 168 otherwise formed in the hook member 162 whereby the outer framework 181 and support column 161 may be directly connected together by the bolt and nut assembly 163, 163*a*.

Figure 29:
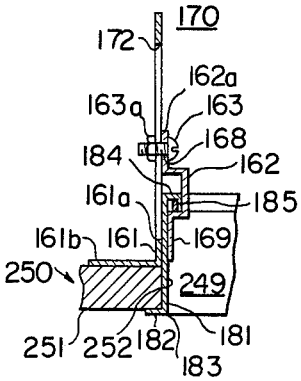
Figure 30:
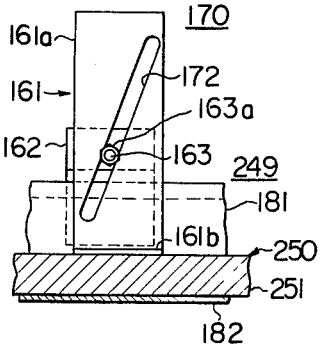
FIG. 30 is a rear view of the modified embodiment of FIG. 29.

FIGS. 29 and 30 fragmentarily show an access door 249 secured to the rough opening 252 in the ceiling panel 251 by the use of a further modified embodiment of the present invention. The anchoring device 170 is substantially similar to the anchoring device 160 of FIG. 28 except that the elongated slot 167 in the support column 161 of the anchoring device 160 of FIG. 28 is replaced by a slanting slot 172 as seen in FIG. 30. The parts of the anchoring device 170 and access door 249 which correspond to those of the anchoring device 160 and access door 248 are assigned corresponding numerals, respectively. As in the case of the access door 248, the access door 249 does not have a cover hinged to the outer framework 181 for uncovering and closing the opening 183 in the outer framework 181 or the cremorne lock means for the cover.

Since the support column 161 has the slanting slot 172, the bolt 163 is prevented from becoming loose. Of course, the slanting slot 172 may be varied in many ways for prevent the bolt 163 from becoming loose.

Although the anchoring devices of the present invention have been described as being applied to access doors to be installed in the rough opening in the ceiling panel, it will be apparent that the anchoring devices can be equally applied to access doors to be installed in building walls.

While various embodiments of the invention have been shown and described in detail it will be understood that these are for the purpose of illustration only and is not to be taken as a definition of the scope of the invention, reference being had for this purpose to the appended claims.

What is claimed is:

1. In combination;

an access door for a rough opening in a panel such as a ceiling or wall panel and having an outer frame adapted to be fitted into the rough opening, an outwardly extending flange integral with the outer end edge of said outer frame extending laterally outwardly of the frame for engaging the outer face of the panel around said rough opening, and an inwardly extending flange integral with the inner edge of the frame on the opposite side of the panel from the outwardly extending flange; and an anchoring device comprising a hanger member having a support arm portion with a threaded hole at one end thereof, and a hook portion integral with the other end of said support arm portion and depending therefrom and engaging with the inwardly extending flange, and a screw-threaded clamping member screw-threadedly engaged in said threaded hole and having the free end extending from the support arm portion in the same direction as said hook portion depends for engagement with the rear face of said panel.

2. The combination as claimed in claim 1 in which said screw-threaded clamping member has abutment means on the free end thereof for abutment with said rear face of said panel.

3. The combination as claimed in claim 2 in which said hanger member further comprises a stop portion integral with said hook portion for engagement with the inner surface of said outer frame member.

4. The combination as claimed in claim 3 in which said stop portion has a screw means therein for securing said stop portion to said outer frame member.

5. The combination as claimed in claim 3 in which said stop portion has a set screw means therein for anchoring said stop portion to said outer frame.

6. The combination as claimed in claim 2 in which said hook portion has a set screw means therein for anchoring said hook portion to said inwardly extending flange.

7. The combination as claimed in claim 2 in which said abutment means is a U-shaped member open toward the rear face of said panel.

8. The combination as claimed in claim 7 in which the ends of said U-shaped member have laterally extending flanges thereon.

9. The combination as claimed in claim 2 in which said abutment means is a U-shaped member open toward said support arm portion and having laterally extending flanges thereon, whereby said abutment means can be engaged with a channel member for supporting the panel and having the channel open in a direction away from the panel.

* * * * *